US005766084A

United States Patent [19]

Smith

[11] Patent Number: 5,766,084

[45] Date of Patent: Jun. 16, 1998

[54] SWING APPARATUS INCORPORATING SAFETY FEATURES

[76] Inventor: Marvin L. Smith, 3 Nelson St., Rockville, Md. 20850

[21] Appl. No.: 659,290

[22] Filed: Jun. 6, 1996

[51] Int. Cl.[6] ..... A63G 9/18

[52] U.S. Cl. ..... 472/120; 472/125

[58] Field of Search ..... 472/118, 120, 472/121, 122, 124, 125

[56] References Cited

U.S. PATENT DOCUMENTS

| | | | |
|---|---|---|---|
| 1,845,832 | 2/1932 | Cottner | 472/125 X |
| 2,531,069 | 11/1950 | McCarty | 472/121 |
| 2,549,085 | 4/1951 | Hines | 472/121 |
| 2,568,015 | 7/1951 | Low | 472/120 |

FOREIGN PATENT DOCUMENTS

| | | | |
|---|---|---|---|
| 120348 | 9/1945 | Australia | 472/120 |

*Primary Examiner*—Kien T. Nguyen

[57] ABSTRACT

A swing apparatus, used primarily for the amusement of children, comprising a partially enclosed seating platform suspended by vertical hangers from an overhead support structure and a linkage mechanism which is used to initiate and sustain the swing pendular motion.

4 Claims, 4 Drawing Sheets

SWING APPARATUS INCORPORATING SAFETY FEATURES

BACKGROUND OF THE INVENTION

1. Field of the Invention

The invention relates generally to a swing apparatus used primarily for the amusement of children. More specifically, the invention relates to a swing apparatus incorporating numerous safety features, and a safer, easier-to-use mechanism for initiating and sustaining the pendular motion of the swing.

2. Description of the Prior Art

Swings providing pendular motion fall into one of two general categories. The most common type comprises a single, laterally mounted seat suspended from an overhead support structure by a pair of flexible vertical hangers. The flexible hangers necessary in this type of swing allow the seat to tip and become unstable, thus making this swing unsuitable for a small child. In addition, the occupant's weight must be shifted in phase with the swing pendular motion in order to sustain the motion, a skill which is difficult or impossible for a small child to learn. This action also substantially increases the risk of the child falling from the swing.

The second type of swing, commonly referred to as a glider or see-saw swing, comprises an elongated horizontal seating platform which is pivotally supported by one or more pair of vertical hangers spaced along the longitudinal axis of the platform. Footrests and handgrips are suitably positioned along the hangers to allow the occupant(s) to apply horizontal forces which create a moment about the upper hanger pivot points. Typically, this type of swing does not provide safe, secure seating for a small child because of the tendency to trap the child between the platform and the hanger as the swing pendulates, and the seating provides no safety restraints to prevent the child from falling laterally off the seating platform.

Because of the disadvantages associated with both types of swings in use today, a new type of swing is needed which provides both safe, stable seating and a safe, easier-to-use means for initiating and sustaining the swing pendular motion.

SUMMARY OF THE INVENTION

The invention relates to a swing apparatus, used primarily for the amusement of children, which incorporates a safe seating compartment for the occupant(s), and a safe, easy-to-use means for initiating and sustaining the pendular motion of the swing. The invention comprises a partially enclosed horizontal seating platform suspended by vertical hangers from an overhead support structure, and a linkage mechanism which may be pulled and pushed by the occupant(s) to initiate and sustain the swing pendular motion. In its preferred embodiment, the invention further comprises a seating platform configured in the shape of an air or space vehicle.

The problems associated with prior-art swings result from unsafe seating for a small child and inadequate means for a small child to initiate and sustain the swinging motion. It is an object of the invention to provide a swing apparatus which provides 1) a safe, partially enclosed seating compartment providing safety restraints; 2) an easy-to-use means for initiating and sustaining swing pendular motion; 3) a linkage mechanism which eliminates pinching the occupant(s) between the seating platform and the vertical hangers as the swing pendulates; and 4) a swing configured in the shape of an air or space vehicle to further enhance the enjoyment of the swing. Further objects and advantages of the invention will become apparent from a consideration of the drawings and description.

Figure 1:
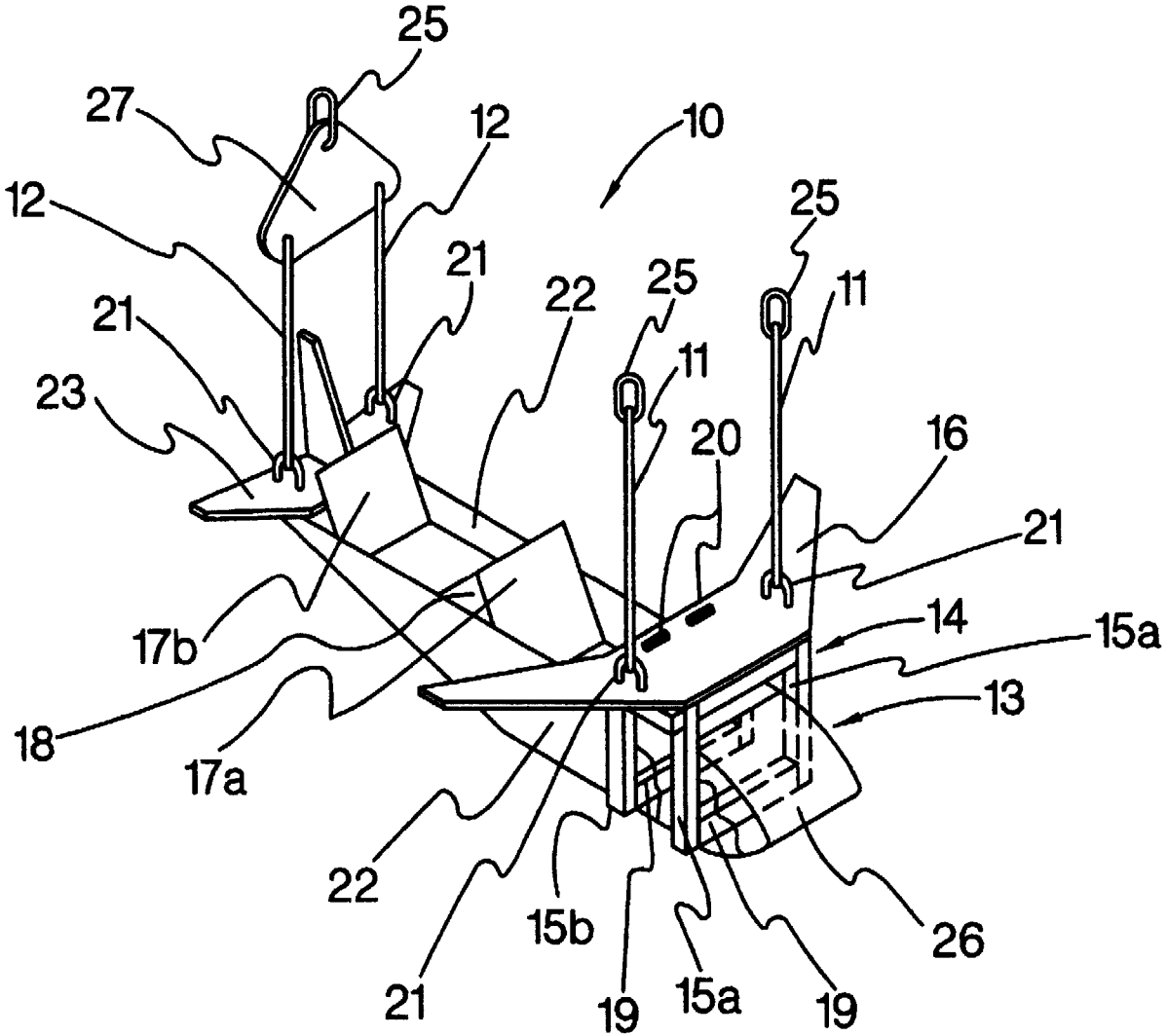
FIG. 1 is an isometric view showing the preferred embodiment of the invention.

| DRAWING REFERENCE NUMERALS | |
|---|---|
| 10 | swing apparatus |
| 11 | first pair of vertical hangers |
| 12 | second pair of vertical hangers |
| 13 | seating platform |
| 14 | linkage mechanism |
| 15a | first pair of vertical links |
| 15b | second pair of vertical links |
| 16 | horizontal link |
| 17a | first seat |
| 17b | second seat |
| 18 | horizontal base |
| 19 | footrests |
| 20 | handgrips |
| 21 | lower attachment means |
| 22 | lateral sides |
| 23 | stationary horizontal member |
| 24 | trunnions |
| 25 | upper attachment means |
| 26 | cowling |
| 27 | hanger plate |
| 28 | pin stiffeners |
| 29 | pins |

DESCRIPTION AND OPERATION OF THE PREFERRED EMBODIMENT

Description

FIG. 1 illustrates the preferred embodiment of the invention. As shown, swing apparatus 10 is configured in the shape of an airplane, although many alternate configurations are possible. Swing apparatus 10 is shown suspended from an overhead support structure (not shown) which may comprise the crossbar of a conventional A-frame gym set or any other suitable, stable support structure. Swing apparatus 10 comprises seating platform 13, first and second pairs of vertical hangers 11 and 12 (respectively), linkage mechanism 14, and hanger plate 27. Seating platform 13 comprises lateral sides 22, horizontal base 18, stationary horizontal member 23, first seat 17*a*, second seat 17*b*, footrests 19, and cowling 26. Linkage mechanism 14 comprises first and second pairs of vertical links 15*a* and 15*b* (respectively), and horizontal link 16.

As shown in FIG. 1, seating platform 13 is suspended from an overhead support structure (not shown) by first and second pairs of vertical hangers 11 and 12 (respectively). First pair of vertical hangers 11 are spaced laterally about the seating platform longitudinal axis and positioned longitudinally at horizontal link 16. Second pair of vertical hangers 12 are spaced laterally about the seating platform longitudinal axis and positioned longitudinally at stationary horizontal member 23. The upper ends of first pair of vertical hangers 11 are connected to the overhead support structure by upper attachment means 25. The upper ends of second pair of vertical hangers 12 are attached to hanger plate 27, which is in turn connected to the overhead support structure by upper attachment means 25. The lower ends of first pair of vertical hangers 11 are connected to horizontal link 16 (of linkage mechanism 14) by lower attachment means 21. The lower ends of second pair of vertical hangers 12 are connected to stationary horizontal member 23 by lower attachment means 21.

Seating platform 13 is an elongated box-type structure. Lateral sides 22 are secured to horizontal base 18, and positioned substantially parallel to one another by cowling 26, footrests 19, first seat 17*a*, and second seat 17*b*, which also serve as structural braces. (Additional cross braces may also be added as required.) Components of seating platform 13 may be individually made of wood, plastic, or other suitable, sturdy construction materials secured to one another with conventional fasteners such as nuts and bolts, screws, or nails. Contrarily, seating platform 13 may be constructed of molded plastic, or similar material, wherein some or all of the components are integral. First and second pairs of vertical hangers 11 and 12 (respectively) may be either flexible or rigid, and in the preferred embodiment of the invention, are made of rope, chain, or other suitable flexible material having sufficient tensile load-carrying capability. When using flexible vertical hangers, upper and lower attachment means 25 and 21 (respectively) are eyebolts, U-bolts, or other similar fasteners. When using rigid vertical hangers, the attachment means must comprise a pivoting means such as bearings or bushings to accomodate rotation of the vertical hangers, relative to both the overhead support structure and the seating platform, about an axis perpendicular to the seating platform longitudinal axis.

Figure 2:
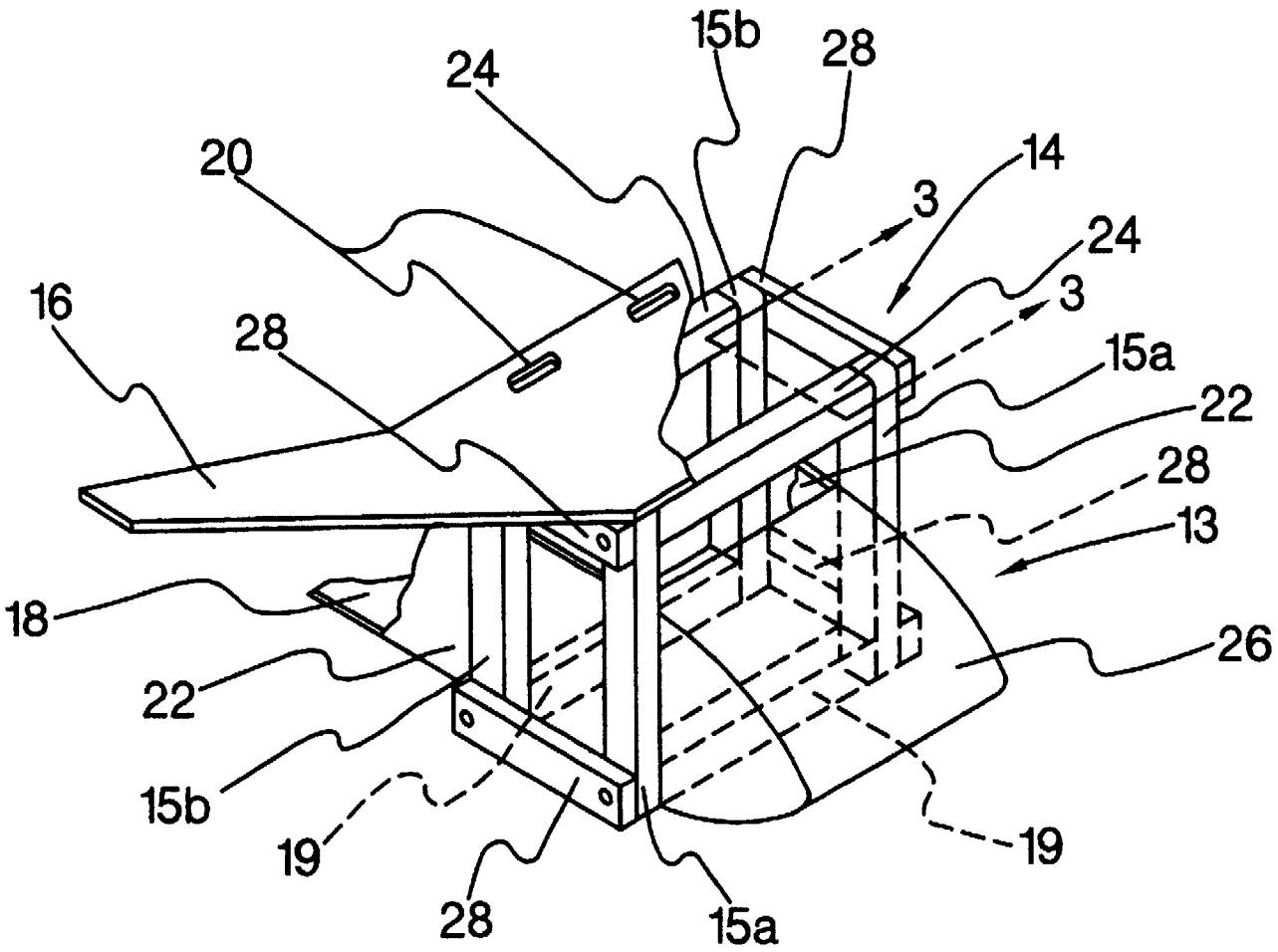
FIG. 2 is an exploded isometric view showing the swing linkage mechanism.

FIG. 2 is an exploded view showing the swing linkage mechanism. As shown, linkage mechanism 14 is connected to seating platform 13. First pair of vertical links 15*a* are spaced laterally about the seating platform longitudinal axis and positioned longitudinally at cowling 26. Second pair of vertical links 15*b* are spaced laterally about the seating platform longitudinal axis and positioned at a distance from cowling 26. The upper ends of first and second pairs of vertical links 15*a* and 15*b* (respectively) are pivotally attached to trunnions 24, which are secured to horizontal link 16. The lower ends of first and second pairs of vertical links 15*a* and 15*b* (respectively) are pivotally attached to footrests 19, which are secured to horizontal base 18. Cut-outs in horizontal link 16 form handgrips 20.

Figure 3:
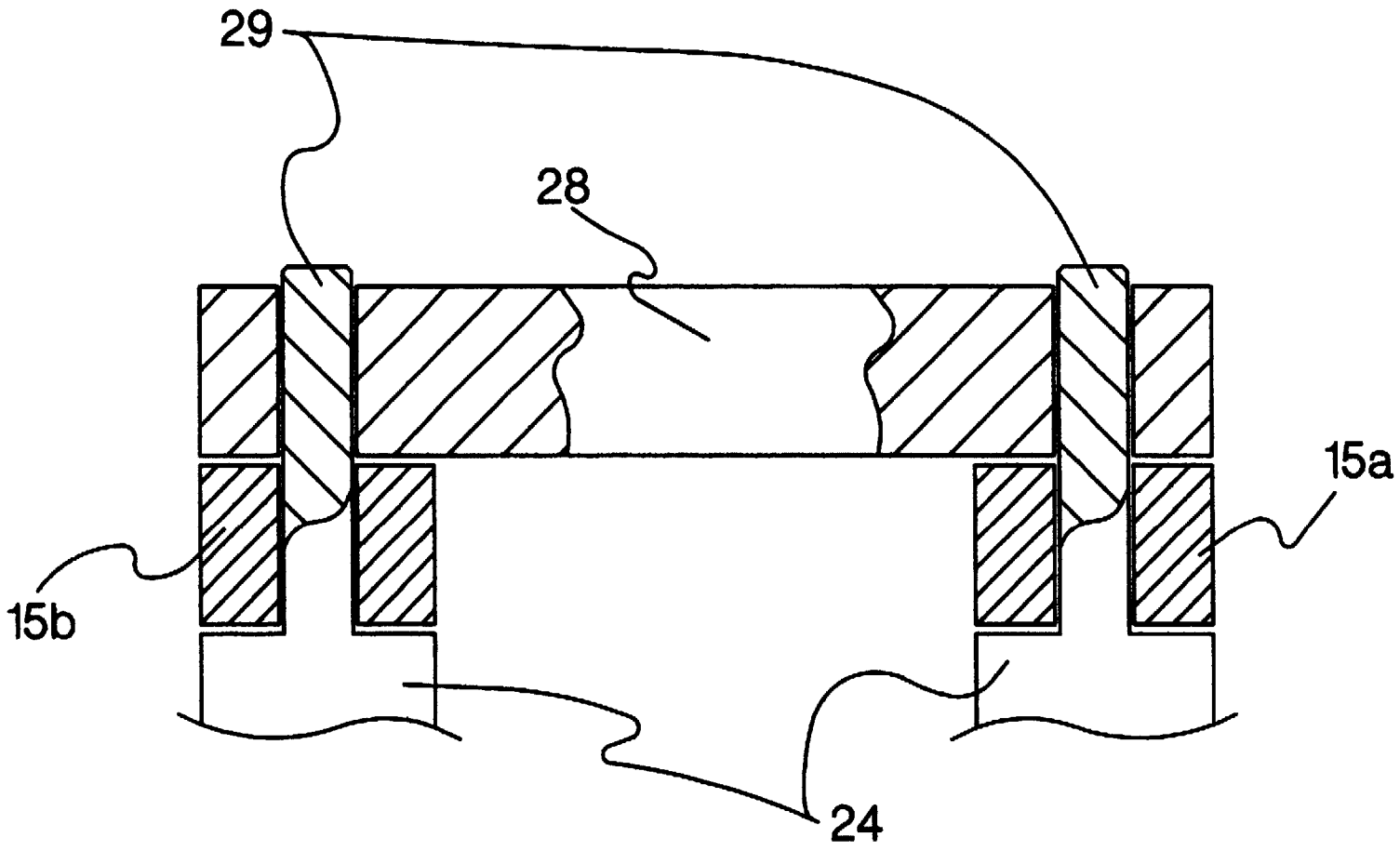
FIG. 3 is a sectional view, along section 3—3 of FIG. 2, showing the pivotal attachment at the upper ends of the first and second pairs of vertical links.

A sectional view of the pivotal attachment at the upper ends of first and second pairs of vertical links 15*a* and 15*b* (respectively) is shown in FIG. 3. As shown, pins 29 of trunnions 24 engage holes through first and second pairs of vertical links 15*a* and 15*b* (respectively), and holes through pin stiffener 28. Pins 29 provide a bearing surface on which first and second pairs of vertical links 15*a* and 15*b* (respectively) pivot. Stiffeners 28 provide support at the outer ends of pins 29 to reduce pin deflection and binding. A similar configuration exists for the pivotal attachment at the lower ends of first and second pairs of vertical links 15*a* and 15*b* (respectively) wherein footrests 19 serve the same function as trunnions 24.

Figure 4B:
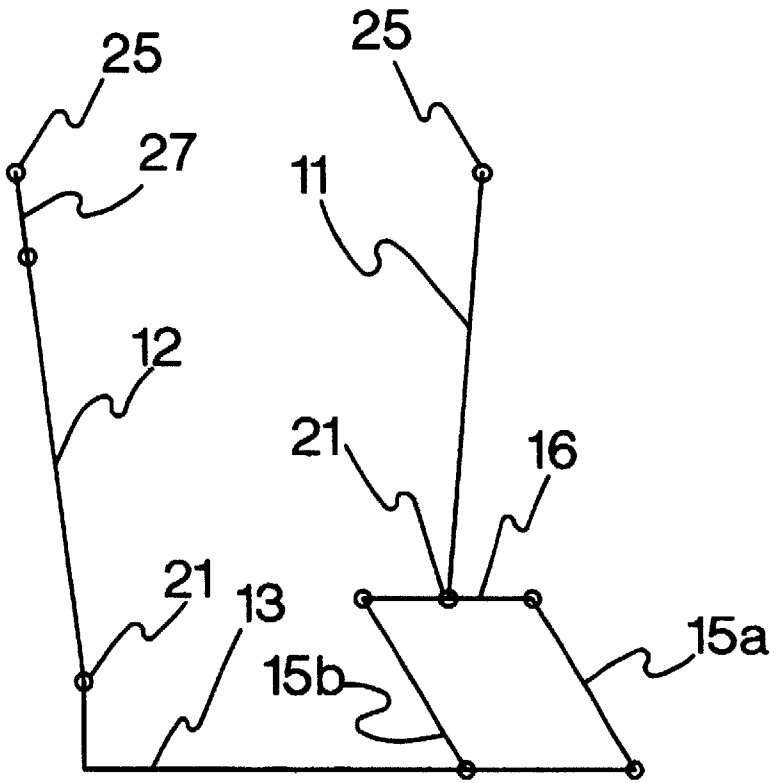
FIG. 4*b* is a kinematic diagram showing the linkage in a deflected position.
Figure 4A:
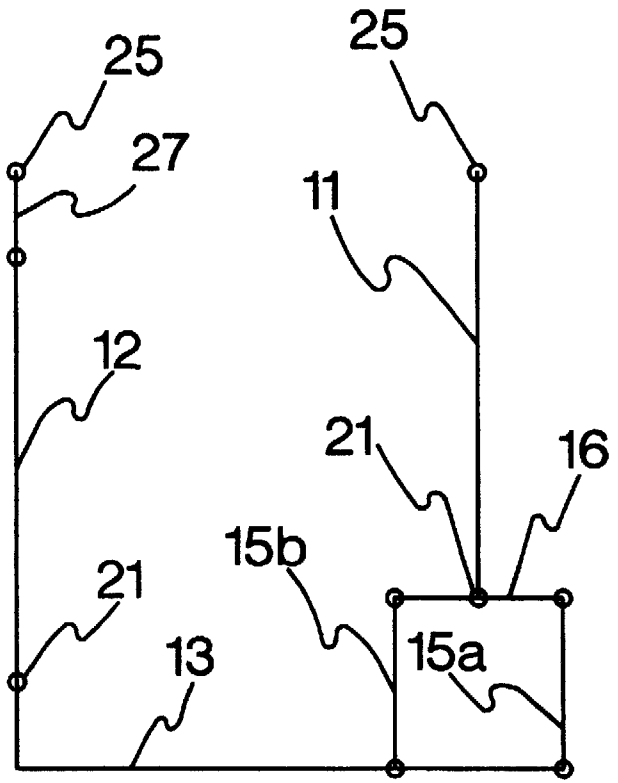
FIG. 4*a* is a kinematic diagram showing the linkage involved in the invention in the at rest position.

FIGS. 4*a* & 4*b* are kinematic diagrams of the linkage involved in the swing apparatus in both at rest and deflected positions, respectively. As illustrated, seating platform 13, first and second pairs of vertical links 15*a* and 15*b* (respectively), and horizontal link 16 substantially form a parallelogram of elements which is deformable in a vertical plane parallel to the seating platform longitudinal axis. In both positions, horizontal link 16 maintains a substantially horizontal attitude when pulled and pushed to initiate and sustain the pendular motion of the swing.

Operation

FIG. 1 illustrates swing apparatus 10, which provides a pendular motion intended for the amusement of children. The apparatus provides a safe, secure ride which can easily be used by a small child without the assistance of a playmate or adult.

Referring to FIG. 1, the occupant(s) of swing apparatus 10 are seated inside seating platform 13 on first and second seats 17*a* and 17*b* (respectively). Seating platform 13 is suspended from an overhead support structure (not shown) at three points to provide stability and prevent tipping in any direction. Lateral sides 22 and first and second seats 17*a* and 17*b* (respectively) provide both lateral and longitudinal restraints to prevent occupant(s) from falling out of seating platform 13 and also provide for appropriate incorporation of safety lap and crotch straps (not shown). Horizontal base 18 provides vertical restraint to safely contain occupant(s) feet within seating platform 13. First and second pairs of vertical hangers 11 and 12 (respectively) are positioned laterally outside seating platform 13 to provide head and body clearance, and to prevent trapping the occupant(s) as the swing pendulates. In addition, linkage mechanism 14 maintains horizontal link 16 in a horizontal attitude and trunnions 24 limit the travel of horizontal link 16, thereby eliminating all potential of trapping an occupant between horizontal link 16 and either first seat 17*a* or lateral sides 22, as the swing pendulates.

To initiate pendular motion, the occupant pulls at handgrips 20 in order to apply a force on horizontal link 16. This force creates a moment which initiates rotation of the swing about upper attachment means 25. At this time the occupant pushes, thereby reversing the direction of the applied force in phase with the reverse pendular motion. Thus, by alternately pulling and pushing in phase, pendular motion is easily sustained and amplified by even a small child.

Although the above description contains specificities pertaining to the construction of the swing apparatus, these specificities should not be construed as limitations on the scope of the invention, but rather as an exemplification of one preferred embodiment thereof. Many variations are possible for the construction of the seating platform, vertical hangers, attachment means, and pivotal attachments of the linkage mechanism. In addition, the swing apparatus may be configured to resemble any air or space vehicle, as well as any real or fictional creature. The invention contemplates these and all other configurations which accomplish an equivalent result.

I claim:

1. A swing apparatus suspended from overhead and providing substantially pendular motion, said swing apparatus comprising:

a. a seating platform comprising substantially vertical lateral sides, a substantially horizontal base, and a seat for the occupants, said seat being rigidly attached to said horizontal base between said lateral sides of said seating platform;

b. first and second pairs of vertical hangers connected at upper and lower ends to attachment means which accommodate rotation of said first and second pairs of vertical hangers about an axis perpendicular to the seating platform longitudinal axis;

c. said first pair of vertical hangers being spaced laterally outside said lateral sides of said seating platform to provide head and body clearance for said occupants;

d. said second pair of vertical hangers being offset at a distance from said first pair of vertical hangers along said seating platform longitudinal axis and spaced laterally outside said lateral sides of said seating platform to provide head and body clearance for said occupants;

e. said upper attachment means of said first and second pairs of vertical hangers being supported from overhead;

f. said lower attachment means of said second pair of vertical hangers being secured to said seating platform;

g. a linkage mechanism for initiating and sustaining said swing apparatus pendular motion, said linkage mechanism comprising:

aa. a first pair of vertical links, having upper and lower ends;

bb. a horizontal link having handgrips and providing head and body clearance for said occupants;

cc. said first pair of vertical links being spaced laterally about said seating platform longitudinal axis;

dd. said upper ends of said first pair of vertical links being pivotally attached to said horizontal link;

ee. said lower ends of said first pair of vertical links being pivotally attached to said seating platform at said horizontal base;

ff. said lower attachment means of said first pair of vertical hangers being secured to said horizontal link;

gg. wherein said occupants alternately pull and push at said handgrips of said horizontal link to initiate and sustain said swing apparatus pendular motion.

2. The swing apparatus of claim 1, wherein said linkage mechanism further comprises:

a. a second pair of vertical links, having upper and lower ends;

b. said second pair of vertical links being spaced laterally about said seating platform longitudinal axis and offset at a distance from said first pair of vertical links along said seating platform longitudinal axis;

c. said upper ends of said second pair of vertical links being pivotally attached to said horizontal link;

d. said lower ends of said second pair of vertical links being pivotally attached to said seating platform at said horizontal base;

e. said horizontal base, said first pair of vertical links, said second pair of vertical links, and said horizontal link substantially forming a parallelogram of elements which is deformable in a vertical plane parallel to said seating platform longitudinal axis;

f. wherein said occupants alternately pull and push at said handgrips of said horizontal link, which maintains a substantially horizontal attitude, to initiate and sustain said swing apparatus pendular motion.

3. The swing apparatus of claim 2, wherein the means for pivotally attaching said first and second pairs of vertical links to said horizontal link and said horizontal base comprises:

a. a pin;

b. a pin stiffener positioned laterally outside said first and second pairs of vertical links;

c. said pin engaging a hole through said pin stiffener and a hole through a link of said first or second pair of vertical links;

d. said pin stiffener being secured to said horizontal link at said upper ends of said first and second pairs of vertical links, or to said horizontal base at said lower ends of said first and second pairs of vertical links.

4. The swing apparatus of claim 2, wherein:

a. said seating platform is configured to resemble an air or space vehicle;

b. said horizontal link is configured in the shape of an air or space vehicle wing;

c. said lower attachment means of said second pair of vertical hangers being secured to a stationary horizontal member of said seating platform;

d. wherein said stationary horizontal member is configured in the shape of an air or space vehicle horizontal stabilizer.

* * * * *